US005207422A

United States Patent [19]

Beene

[11] Patent Number: 5,207,422

[45] Date of Patent: May 4, 1993

[54] BOWLING ALLEY BUMPER SYSTEM

[76] Inventor: Bobby R. Beene, 9919 Ila Dr., Dallas, Tex. 75220

[21] Appl. No.: 842,005

[22] Filed: Feb. 25, 1992

[51] Int. Cl.[5] ..... A63D 5/00

[52] U.S. Cl. ..... 273/37; 273/51; 273/54 R

[58] Field of Search ..... 273/37, 51, 54 R

[56] References Cited

U.S. PATENT DOCUMENTS 3,401,933 9/1968 Conklin et al. ..... 273/51
4,330,122 5/1982 Sheinberg et al. ..... 273/51
4,900,024 2/1990 Chandler et al. ..... 273/37

*Primary Examiner*—V. Millin
*Assistant Examiner*—William M. Pierce
*Attorney, Agent, or Firm*—Timmons & Kelly

[57] ABSTRACT

An improved bowling alley bumper system for selectively guarding against the throwing of gutter balls. An elongated guard is supported alongside the gutter and can be pivotally retracted or extended between a first position in which the gutter is exposed and unguarded and a second position in which gutter entry by a bowling ball is precluded by constructing the predominant portion of the system of prefabricated modular sections of relatively lightweight component parts, they can be longitudinally positioned end-to-end enabling significant cost savings to be realized for both fabrication and installation.

9 Claims, 4 Drawing Sheets

BOWLING ALLEY BUMPER SYSTEM

FIELD OF THE INVENTION

The field of art to which the invention relates comprises bowling alley bumper systems and more particularly such systems in which elongated retractable bumpers are disposed alongside the gutters.

BACKGROUND OF THE INVENTION

In recent years there has been an increased trend toward encouraging bowling among the handicap, the young and otherwise unskilled bowlers by the use of bumper systems that preclude the throwing of "gutter balls". In such systems, an elongated longitudinal guard is either permanently, removably or retractably placed in a blocking relation along the length of the gutter for a selected bowling lane. The presence of the bumper prevents inaccurately thrown balls from entering the gutter anywhere along the length of the bowling lane by deflecting a bumped ball back into the lane toward the pins. The effect thereof is to prevent the thrower of the ball, particularly an unskilled bowler or the young from becoming discouraged toward the game. Instead, it provides a psychological uplift in that by means of such bumpers every thrown ball results in at least some downed pins and a realization of scoring. At the same time, the costs of such systems is, as always, a paramount concern to the proprietor of the bowling alley.

BACKGROUND OF THE PRIOR ART

Various bumper systems at bowling alleys have heretofore been proposed as disclosed for example in U.S. Pat. Nos. 3,046,012; 4,330,122 and 4,420,155.

In U.S. Pat. No. 4,900,024, of which I am a co-inventor, there is disclosed a novel and commercially successful bumper system for installation at any number of selected bowling lanes. The system deploys retractably mounted bumpers alongside the otherwise conventional gutters of the bowling alley. When the bumpers are retracted, they are positioned alongside the outer edge of the gutters so as to provide conventional gutter exposure in which a badly thrown bal can readily enter. When bumping is desired, the bumpers are extended parallel and overlying the gutters so as to ward off and deflect any bowling ball that would otherwise have entered the gutter.

OBJECTS OF THE INVENTION

It is an object of the invention to provide novel improvements for a retractable bowling alley bumper system.

It is a further object of the invention to provide a functionally similar bumper system as in the previous object while effecting significant cost savings in the fabrication and installation of such systems.

It is a still further object of the invention to effect the previous objects with a structural arrangement for such a system that is aesthetically enhanced while functioning also to abate or eliminate audible and visible distraction commonly associated with the conventional ball return.

SUMMARY OF THE INVENTION

This invention relates to improved bumper systems for a bowling alley. More specifically, the invention relates to improvements for retractable bumper systems of a type disclosed in U.S. Pat. No. 4,900,024 whereby to reduce the cost of fabrication and installation thereof. At the same time, additional improvements reside in aesthetic enhancement while reducing the noise level and distraction associated with a proximately located ball return.

The foregoing is achieved by the bumper system hereof constructed of light weight materials, largely prefabricated in modular sections for simplified on site assembly. Each modular section is typically comprised of opposite units that include an elongated first channel adapted to be secured to a base extending along the outside edge of each gutter. A plurality of bumper rail support arms are each pivotally mounted within a short channel locally received at longitudinally spaced locations within the first channel. The opposite, arcuately displaceable end of each support arm is in turn pivotally secured to a length of bumper rail. Collectively, the support arms support the individual lengths of bumper rail enabling its displacement toward and away from the first channel in unison. For proximately located gutters, the first channels are oppositely placed in pairs and secured back to back. To accommodate spaced apart double gutters with an intervening ball return, transverse supports at spaced locations between the channels secure them in parallel spaced apart relation.

Vertical sides and horizontally extending top sections overlying the length of the bumper system form an enclosure so as to enhance the aesthetics of the installation while visibly and audibly abating the distraction otherwise caused by a returning ball within the ball return.

The above noted features and advantages of the invention as well as other superior aspects thereof will be further appreciated by those skilled in the art upon reading the detailed description that follows in conjunction with the drawings.

DESCRIPTION OF THE PREFERRED EMBODIMENT

Figure 1:
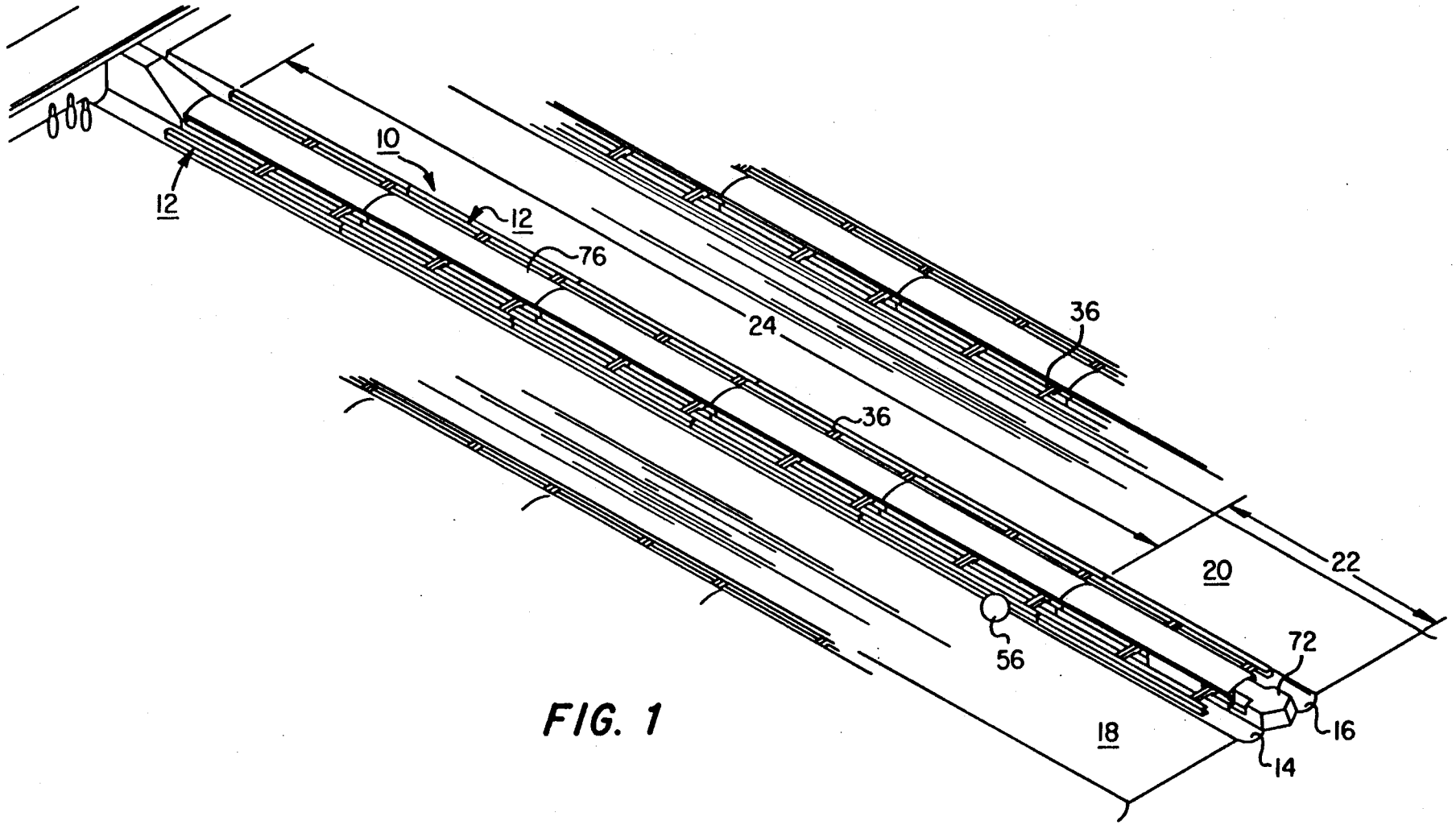
FIG. 1 is a perspective fragmentary view of adjacent bed lanes of a bowling alley fitted with the double gutter embodiment of the invention.

In the description which follows, like parts are marked throughout the specification and drawings with the same reference numerals respectively. The drawing figures are not necessarily to scale and in certain views, parts may have been exaggerated for purposes of clarity.

Figure 2A:
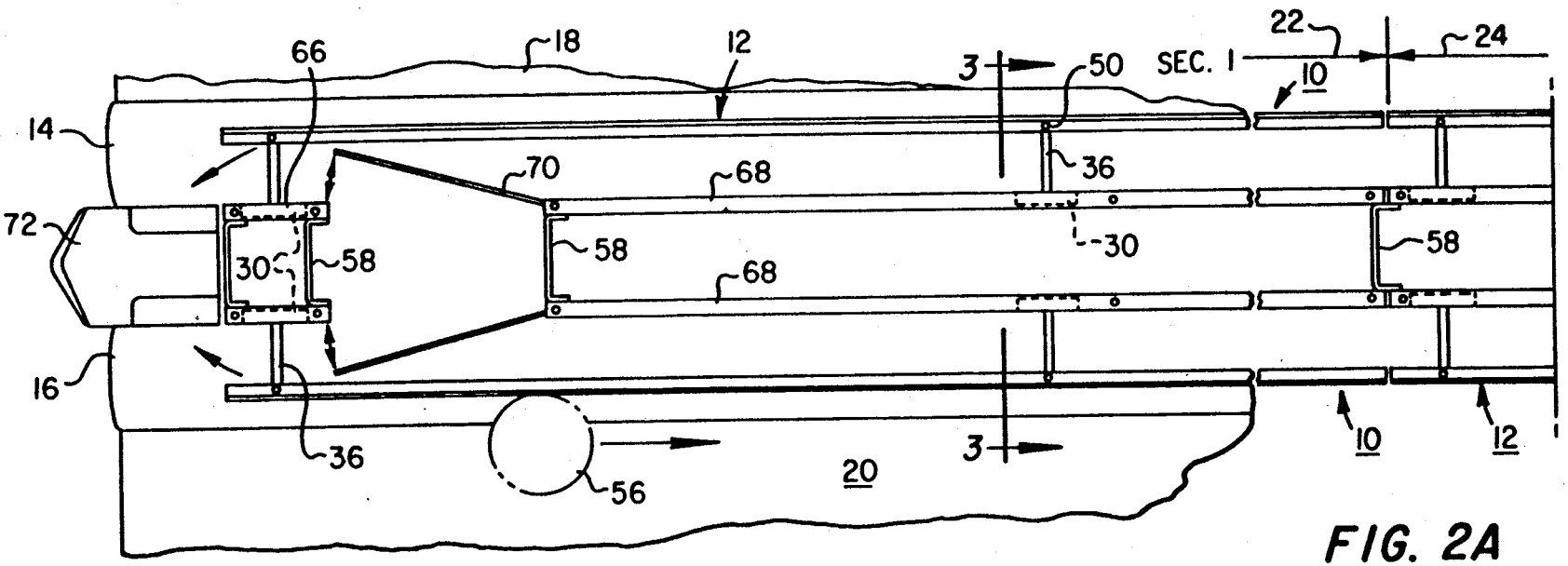
FIGS. 2 A and 2 B are continuing plan views of the bumper system embodiment of FIG. 1.
Figure 2B:
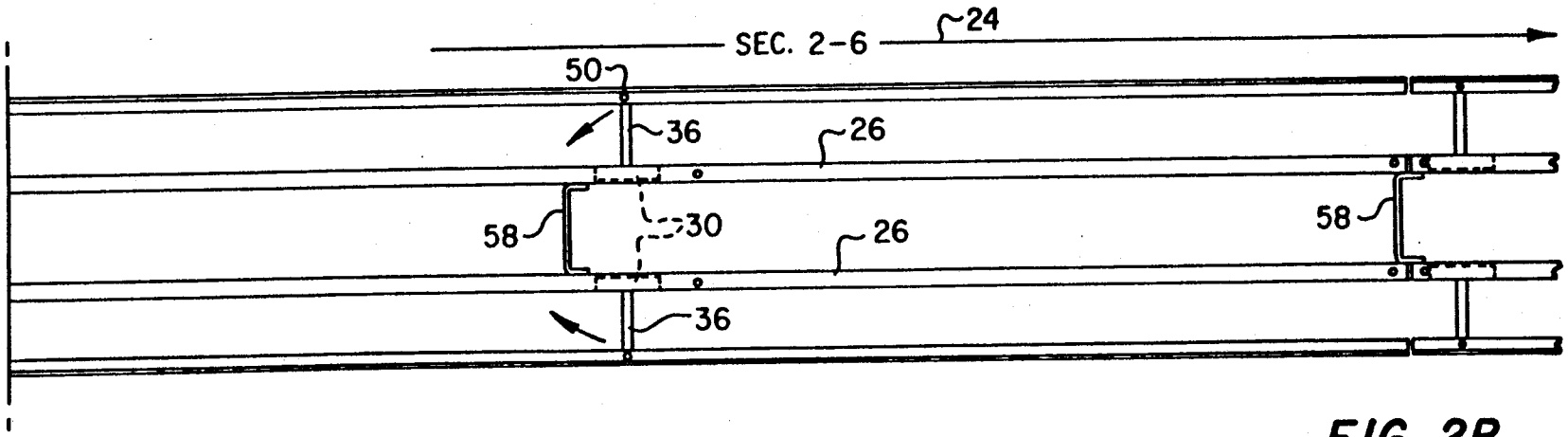

Referring now to FIGS. 1 and 2, there is illustrated the bumper system of the invention designated 10 for a double gutter embodiment. Retractable bumper rails 12 are shown extended and disposed longitudinally over gutters 14 and 16 of adjacent bed lanes 18 and 20 so as to deflect a ball 56 from entering the gutter. As will be understood, the bumper system 10 is comprised of six sections connected longitudinally end-to-end in which the five trailing sections 24 are completely modular and the one leading section 22 is basically similar.

Figure 3:
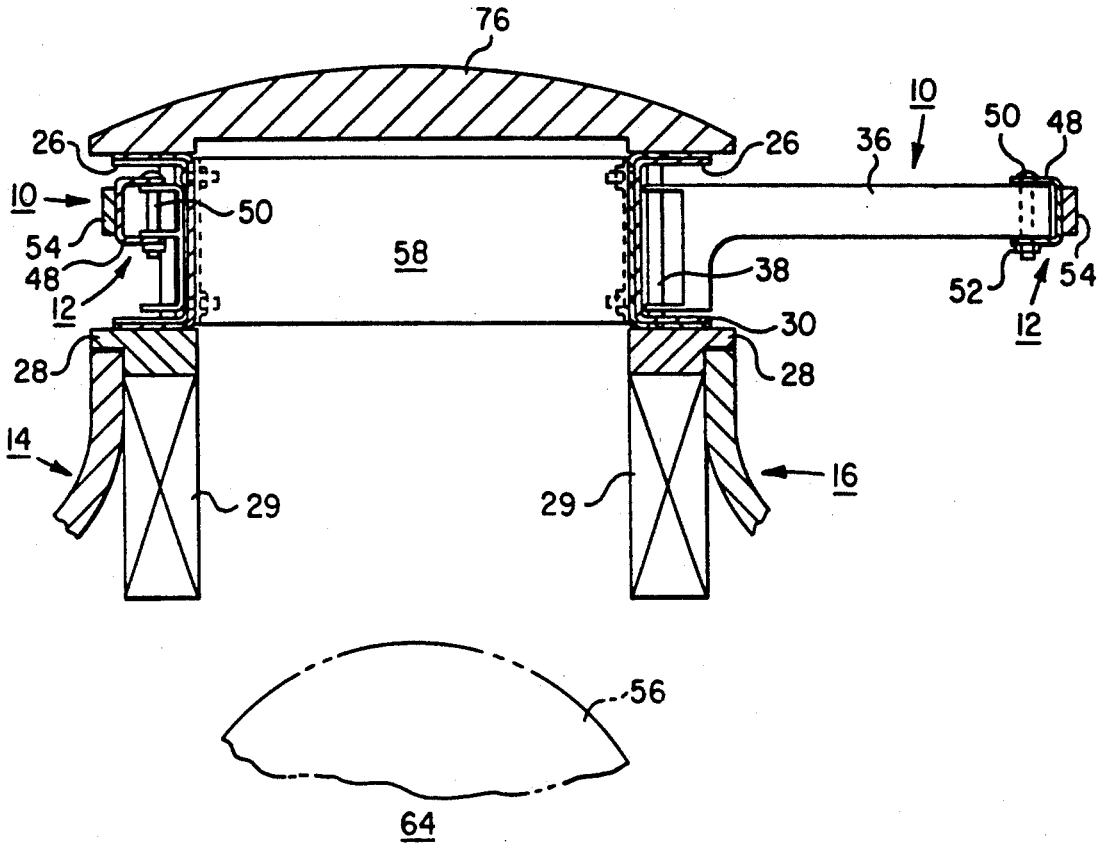
FIG. 3 is a sectional view taken substantially from the position 3—3 of FIG. 2A.
Figure 4:
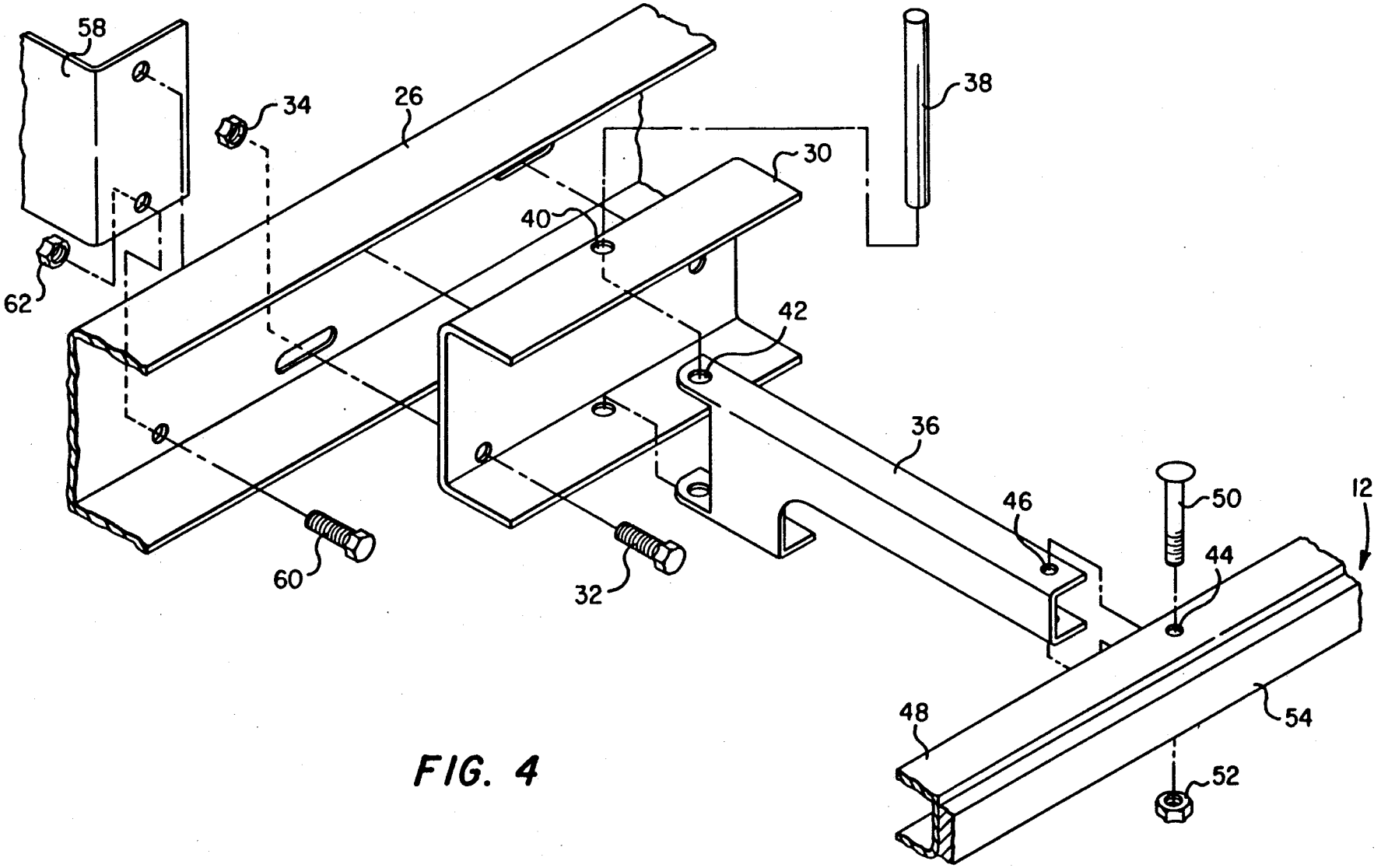
FIG. 4 is an exploded isometric view of the bumper rail support arm assembly.

The details of construction can be best understood by reference to FIGS. 2–4 from which it will be appreciated that both the leading section 22 and the plurality of trailing sections 24 consist of paired right and left hand units that are opposite but otherwise modular duplicates of each other. As such, each unit of each section can be prefabricated separately for minimal on site assembly or both units can be prefabricated together in a complete module for direct mounting on site as will be explained.

Looking first at the modular sections 24, each opposite unit is comprised of a ten foot length mounting channel 26 secured through the flooring support 28 adjacent gutters 14 and 16 to underlying beam 29. The upper surface of floor support 28 is slightly elevated with respect to the adjacent bed surfaces of lanes 18 and 20. At periodic selected intervals along the length of each unit there is provided a short length of local channel 30 dimensioned so as to be received within channel 26 and secured thereto via a plurality of pan head screws 32 and nuts 34. In turn, received within channel 30 is an elongated support arm 36 having a rear yoke defining vertically aligned apertures 42. A vertical pin 38 disposed through channel apertures 40 and arm apertures 42 enable the support arm to be supported pivotally displaceable therein.

The opposite distal end of support arm 36 is received in bumper 12 comprised of an approximately ten foot length of elongated channel 48 to which a front facing elastomeric strip 54 is suitably attached. The arm is pivotally joined to channel bumper 48 by aligning apertures 44 of channel 48 with apertures 46 of arm 36 and securing them together via vertical bolt 50 and nut 52. Strip 54 being secured to the front face of channel 48, serves when struck by a thrown ball 56 heading toward an underlying gutter, to deflect the ball back onto the lane bed as will be understood.

Securing the opposite units of each section together in the double gutter embodiment being described is a transversely supported span plate 58 to which each of the opposite mounting channels 26 are secured via pan head screws 60 and nuts 62. The span plates are longitudinally located adjacent the vicinity of each local channel 30 of this embodiment and has a transverse dimension of about seven inches or at least sufficient to span the underlying ball return spacing 64. In FIG. 3, a ball 56 is shown in phantom in the course of being returned in space 64.

For the units of leading section 22, the mounting channel 66 and the spaced mounting channel 68 are comprised of shorter length equivalents of channel 26 described supra. The longitudinal spacing therebetween allows for hinged doors 70 through which a returned ball 56 can be retrieved. Within each of the channels 66 and 68 similarly as above, is a local channel 30 supporting an arm 36 pivotally connected to bumper 12. Likewise, span plates 58 secure the mounting channels together as described supra.

By enclosing the top portion of space 64 with the continuous channels 26, audible and visual distraction of a returning ball is abated if not completely eliminated. A series of spanning caps 76 are also secured end-to-end overlying the upper flanges of channels 26, 66 and 68. Hinges or bolts secure the caps to the underlying flanges of the mounting channels.

Figure 5:
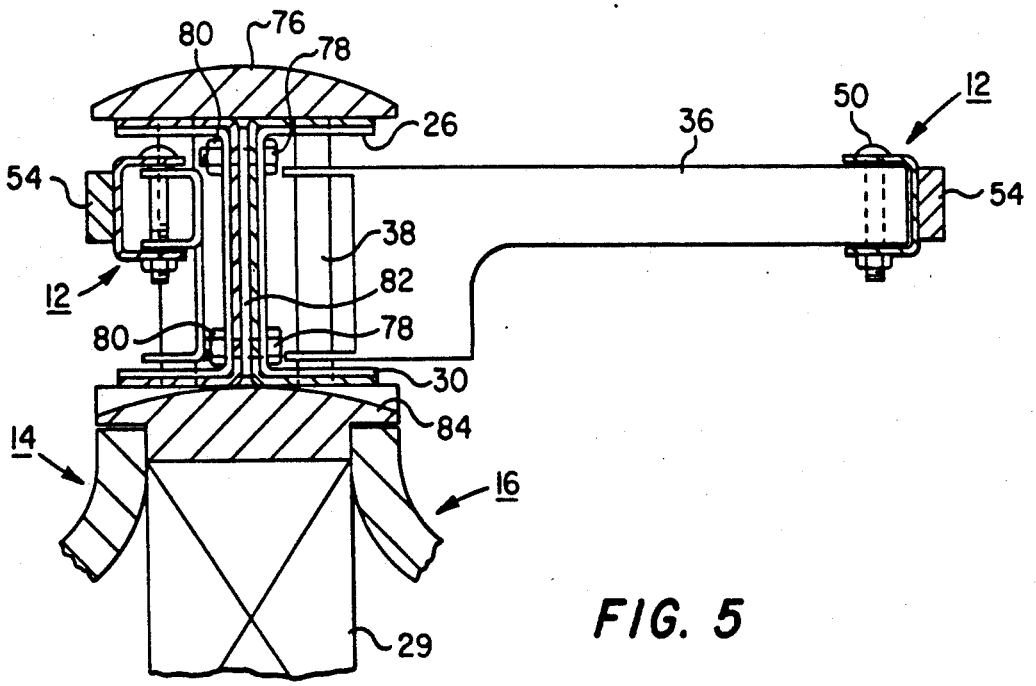
FIG. 5 is a sectional view similar to FIG. 3 for the common gutter embodiment hereof.

For the second common gutter embodiment hereof lacking the intervening ball return, the opposite units of the various sections are the same components as before less channel plate 58. Instead, an intervening longitudinal plate 82 is utilized for essentially back-to-back joinder of the opposite mounting channels as illustrated in FIG. 5. Specifically, the mounting channels 26, 66 and 68 are respectively secured back-to-back against intervening plates 82 via bolts 78 and nuts 80. Underlying floor support may comprise support 28 or alternatively can comprise the existing common capping 84 as shown.

For either embodiment, the support arms 36 are pivotally supported via pins 38 so as to move pivotally in paired unison with displacement of bumper rail 12. In this manner, the rail lengths can be individually displaced between the retracted position shown on the left side of FIGS. 3 and 5 for exposing the underlying gutters to the fully extended bumper position illustrated on the right side of FIGS. 3 and 5 guarding the underlying gutters.

By the above description their is disclosed a novel construction for an improved bowling alley bumper system that is less costly to fabricate and install than previously known. Each modular section 24, or alteratively the separate opposite and modular units of each section, can be completely prefabricated with its floor support 28 or caps 84. Installation is then effected directly onto support beam 29 in end-to-end relation with the other modular sections. Likewise, section 22 and the units thereof can be prefabricated and similarly positioned in place on beam 29 ahead of the first of the modular sections 24. Yet where preferred, as in some retrofit situations, one or more components of the individual sections or units by virtue of their simplicity can be readily assembled on site.

Being that the individual sections are almost entirely modular, the components thereof can be readily mass produced at minimum cost and easily assembled prefabricated ready for shipment to the installation site. On arrival at the site, the modular light weight sections require a minimum of installation effort to mount and secure each flooring section 28 or existing capping 84 to the underlying support beam 29 available at the individual bowling lanes for receipt thereof. The components are relatively simple in structure with most of the metal components being formed of 16 gauge cold rolled steel and others such as arm 36 and bumper 44 being constructed of 14 gauge cold rolled steel.

By virtue of the simplicity associated with the construction, assembly and installation of the components, it is evident the system is neither material nor labor intensive. As a result, significant savings in the cost of fabrication and installation is achieved as compared to prior constructions therefor. At the same time, by utilizing the system to afford complete enclosure of the ball return, the otherwise distracting affects of noise and sight of a returning ball is avoided. The virtues thereof can be readily appreciated by those skilled in the art.

Since many changes could be made in the above construction and many apparently widely different embodiments of this invention could be made without departing from the scope thereof, it is intended that all matter contained in the drawings and specification shall be interpreted as illustrative and not in a limiting sense.

I claim:

1. In a bumper system for selectively guarding a gutter of a bowling alley in which said gutter is adjacent to said alley and extends from a ball delivery entrance location to a discharge exit location, said bumper system being operative when selectively set to prevent entry of a thrown ball delivery onto said alley from entering said gutter and including displaceable longitudinal bumper members collectively extending substantially the length of said gutter, support means secured to a support surface of said bowling alley alongside of the gutter for the substantial length thereof to support said bumper members for displacement between a first relation in which said gutter is exposed to permit entry of a ball delivered onto the alley and a second relation in which said gutter is guarded against entry of a ball delivered onto the alley; the improvement in which said support means is comprised of a plurality of individual sections collectively extending longitudinally end-to-end parallel and substantially the length of the gutter from said entrance location to said exit location with a significant number of said sections being comprised of a common modular unit each containing an elongated length of channel shaped support, a correlated length of bumper member and at least one mounting member pivotally securing said bumper member to said channel shaped support, wherein each of said channel shaped supports are adapted to be fastened to said alley support surface in said end-to-end arrangement.

2. In a bumper system in accordance with claim 1 in which said support means has an entire collective length when installed that includes at least one section that is non-modular with respect to the modular units of the remaining sections completing said collective length and said non-modular section is located at a portion of the gutter adjacent the ball delivery location of the bowling alley.

3. In a bumper system in accordance with claim 1 in which said bowling alley has adjacent gutters associated with intervening between said gutters and the channel shaped support of said modular units are oppositely secured back to back on said at least one support surface and at least the opposite of said modular units are pre-assembled to enable efficient on-site installation.

4. In a bumper system in accordance with claim 2 in which said adjacent gutters form either a double gutter construction having an intervening ball return or a common gutter construction devoid of an intervening ball return and said modular units are structurally adapted when assembled for use with either said double gutter or said common gutter construction.

5. In a bumper system in accordance with claim 2 in which at least the modular of said opposite units are each comprised of a plurality of longitudinal channel shaped supports including a first elongated channel shaped support extending substantially the length of its section and adapted to be fastened alongside the gutter to said at least one support surface of said bowling alley, at least a pair of second channel shaped supports of relatively shorter length than said first channel shaped support and received longitudinally positioned locally within said first channel shaped support, an elongated bumper member and at least a pair of said mounting arms each pivotally mounted between one of said second channel shaped supports at one end and pivotally mounted to said elongated bumper member at its other end for said mounting arms to be pivotally displaceable in unison whereby said bumper member can be positioned on said support means into and away of said first and second relations.

6. In a bumper system in accordance with claim 5 in which the bowling alley has adjacent gutters associated with adjacent alleys and defining a double gutter construction having a ball return spacing intervening therebetween and said modular units are structurally adapted for use with said double gutter construction and there is included a structural member transversely securing the opposite of said modular units parallel and spaced apart back-to-back to form said sections and allow for spanning the ball return spacing intervening therebetween.

7.

8. In the method of fabricating components for a bumper system to selectively guard a gutter of a bowling alley against a thrown ball delivered onto said alley from entering said gutter, said gutter extending adjacent to said alley from a ball delivery entrance location to a distance exit location and said alley has a longitudinal support surface adjacent to said gutter and including displaceable longitudinal bumper members collectively extending substantially the length of said gutter, support means secured from about said support surface alongside of the gutter to support said bumper members for displacement between a first relation in which said gutter is exposed to permit entry of a ball delivered onto the alley and a second relation in which said gutter is to be guarded against entry of a ball delivered onto the alley; the improvement in which said support means is fabricated by the step of forming a plurality of individual sections which when installed collectively extend longitudinally in an end-to-end arrangement substantially the length of the gutter with a significant number of said sections being fabricated of a common modular unit, each of the modular of said units including the fabrication steps of provided an elongated length of channel shaped support, providing a correlated length of bumper member and providing at least one mounting member for pivotally securing said bumper member to said channel shaped support, wherein each of said channel shaped supports are adapted to be fastened to said alley support surface in said end-to-end arrangement.

9. In the method of fabricating a bumper system in accordance with claim 8 in which said bowling alley has adjacent gutters associated with adjacent alleys and at least one support surface located intervening between said gutters and the channel shaped support of said modular units are adapted to be oppositely secured back to back on said at least one support surface when assembled and at least the opposite of said modular units are pre-assembled in said fabrication step to enable efficient on-site installation.

* * * * *